US010468762B1

(12) United States Patent
Knight et al.

(10) Patent No.: US 10,468,762 B1
(45) Date of Patent: Nov. 5, 2019

(54) VERSATILE ANTENNA WIRE AND METHODS OF MANUFACTURING

(71) Applicant: Remarkable Technologies, Inc., Avon, CT (US)

(72) Inventors: Eric A. Knight, Unionville, CT (US); Rodney J Lane, Unionville, CT (US)

(73) Assignee: Remarkable Technologies, Inc., Avon, CT (US)

( * ) Notice: Subject to any disclaimer, the term of this patent is extended or adjusted under 35 U.S.C. 154(b) by 117 days.

(21) Appl. No.: 15/641,595

(22) Filed: Jul. 5, 2017

Related U.S. Application Data

(60) Provisional application No. 62/411,838, filed on Oct. 24, 2016.

(51) Int. Cl.

| | |
|---|---|
| ***H01Q 1/36*** | (2006.01) |
| ***H01Q 1/40*** | (2006.01) |
| *H01B 3/44* | (2006.01) |
| *H01B 3/30* | (2006.01) |
| *H01B 3/28* | (2006.01) |
| *H01B 3/46* | (2006.01) |
| *H01B 3/42* | (2006.01) |

(52) U.S. Cl.
CPC ..... *H01Q 1/36* (2013.01); *H01Q 1/40* (2013.01); *H01B 3/28* (2013.01); *H01B 3/302* (2013.01); *H01B 3/305* (2013.01); *H01B 3/306* (2013.01); *H01B 3/421* (2013.01); *H01B 3/44* (2013.01); *H01B 3/441* (2013.01); *H01B 3/443* (2013.01); *H01B 3/46* (2013.01)

(58) Field of Classification Search
CPC .. H01Q 1/36; H01Q 1/38; H01Q 1/40; H01Q 9/065; H01Q 9/26; H01Q 9/42
See application file for complete search history.

(56) References Cited

U.S. PATENT DOCUMENTS

| | | | | |
|---|---|---|---|---|
| 6,215,454 | B1 * | 4/2001 | Tran | H01Q 1/243 343/702 |
| 6,680,702 | B2 * | 1/2004 | Yde-Andersen | G08B 13/2414 343/700 MS |
| 7,009,576 | B2 * | 3/2006 | Adamson | B60C 11/00 152/152.1 |
| 2016/0240926 | A1 * | 8/2016 | Mikami | H01Q 9/26 |

* cited by examiner

*Primary Examiner* — Daniel Munoz
*Assistant Examiner* — Patrick R Holecek

(57) ABSTRACT

In accordance with example embodiments of the present disclosure, the invention allows effective sending and receiving of radio signals commonly associated with those sent and received by antennas. The utility of the invention includes a versatile antenna wire comprised of an embedded formed electrical conductor within a protective, non-electrically conductive sheath or structural element that facilitates shorter-than-typical antenna designs. The versatile antenna wire can facilitate antenna radiators that are up to 80 percent shorter than traditional wire radiators—while still providing exceptional operating characteristics. In some embodiments, the antenna wire is a specifically contoured conductive material. Electrically conductive material may be wire; metalized tape; metalized foil; electrically conductive polymer; or conductive ink or coating.

19 Claims, 12 Drawing Sheets

700

VERSATILE ANTENNA WIRE AND METHODS OF MANUFACTURING

TECHNICAL FIELD

The present disclosure relates generally to the field of antenna design and more specifically to the field of receiving and transmitting via the use of specially formed antenna wire.

BACKGROUND

Antennas made of wire are the oldest type of antenna system. They are generally easy to construct, but, particularly on frequencies below VHF (below 30 MHz), their required length can be inconvenient or not practical for the space available for their construction and use.

A common wire antenna used on frequencies below 30 MHz is called a "dipole", in which equal lengths of wire (typically copper wire) are typically fed by a two-conductor RF transmission line or feed line (such as coaxial cable, ladder line, or twin lead) at a wire junction. The combined length of the two antenna wire components is traditionally determined by the formula:

$$l=468/f$$

Where "f" is the desired resonance frequency in megahertz and the resultant length "1" is in feet. For example, for an antenna to be resonant on 3.755 MHz, a frequency in a popular amateur "ham" radio band, the overall length of the wire needed is approximately 124.6 feet (468 divided by 3.755). In a classic dipole configuration, this length of wire is divided in two (62.3 feet for each wire radiator) and fed by a two-conductor transmission line. To suspend the wire elements, the end points of the wire segments are attached to non-electrically conductive elements (insulators), usually made of ceramic or plastic. The insulators are fastened to lengths of non-electrically conductive support line, such as rope. The rope ends are typically fed through pulleys attached to support structures; tension is applied to the overall rope-and-wire system to create a horizontal antenna system.

One unavoidable problem with this type of antenna is that tension is created throughout the entire system, including the wire elements. Over time, it is common for the wire to stretch and break—and thus requiring the wire element(s) to be repaired or replaced.

Another problem with a common dipole antenna is the overall length required. In the above example, a radio operator may not have the 124.6 feet necessary on his or her property to suspend the dipole. Apartment dwellers and homeowners with small properties may be particularly challenged to find the 124.6 feet of horizontal space without impinging on neighbors' properties.

As inadequate horizontal space is such a common problem, a number of options have been developed to modify a dipole to function at a shorter-than-natural resonant length.

One shorter-length option is to include what is commonly referred to as "loads" in the lengths of wire; these loads are typically comprised of coils that electrically simulate a longer length of wire. However, the efficiency and performance of"loaded dipoles" is significantly less than full-length dipoles.

Another shorter-length option is something called a "Slinky®-antenna"—whereby the wire of the antenna is made of a child's Slinky® toy, which is essentially coiled spring-metal. There are numerous problems and deficiencies with the coiled spring-metal antenna. One such deficiency is that the coils are not ordinarily created by the end-user; the coiling process of the spring steel is beyond the means of most people. Another deficiency is that a coiled spring-metal antenna can only be stretched out to approximately 15 feet without permanently deforming the coil. Other common reported deficiencies include that the resonance, impedance, and standing-wave ratio (SWR) characteristics of the coiled spring-metal antenna tend to change when wet. Another deficiency of the coiled spring-metal antenna is inherent in the coil itself, as the antenna radiators are essentially large helical inductors which provide unusual and inefficient RF transmission and reception characteristics. All in all, due to these and other deficiencies, the coiled spring-metal antenna has never gained wide acceptance in the RF-transmission community.

Beyond the common dipole antenna, there are other popular wire-antenna types that suffer similar disadvantages, whereby persons do not have the physical space on their properties to readily install them. This is particularly noted on lower operating frequencies where the associated radio wavelengths (and thus resonant antenna wires and/or elements) are long. These disadvantaged wire-antenna types include end-feds, slopers, doublets, inverted vees, G5RVs, OCFs, long wires, and wire beams.

Moreover, even when a person has the physical, horizontal space to install a full-size antenna, there are instances where height is the limiting factor. For instance, in some communities there are zoning restrictions related to structure heights. In other instances, there are personal and/or aesthetic inhibitions to erect antenna structures that can be upwards of 60-70 feet tall.

Given the above-described issues with shortened antennas, and the practical limitations and restrictions of full-size antennas, one skilled in the art would understand the benefits of antennas and antenna components that provide the function of physically larger, full-size antennas and antenna components without employing coils that compromise performance.

SUMMARY

The present disclosure relates to an apparatus and methods of manufacture of a versatile antenna wire that dramatically reduces the length of wire antenna radiators compared to traditional methods. Testing of this versatile antenna wire has shown radiator length reductions of up to 80%.

An example embodiment includes a wire or other electrically conductive material formed in a pattern that is embedded in a protective, non-electrically conductive sheath. The apparatus is configured to reduce the length required to install an antenna while providing the performance of a physically longer or taller antenna.

In some embodiments a non-electrically conductive sheath, otherwise referred to as a structural element, has a tensile strength sufficient to support the embedded formed wire between two mounting points. When such a non-electrically conductive sheath is of sufficient tensile strength to support the apparatus under tensile load, the wire is not under stress or strain in the application. In other words, the apparatus does not rely on the wire to provide tensile strength in the application of the apparatus.

In some embodiments, the non-electrically conductive sheath containing the formed wire has holes through its construction. A taut length of non-electrically conductive support line, threaded through the holes, provides the necessary support to eliminate stress or strain on the embedded wire.

In some embodiments, the embedded wire is conductive material, such as conductive foil or foil tape.

In some embodiments, the non-electrically conductive sheath has a greater tensile strength than the embedded wire, and in many cases greater inherent shock-absorbing capability—providing beneficial resiliency during severe weather conditions. One skilled in the art understands that a range of materials may be employed to form a non-electrically conductive sheath encasing formed wire or other formed conductor, and that a sheath may also be a structural element. Various forms of rubber, castable or extrudable elastomeric polymers, thermally formed or bonded insulating materials, and composites are commonly used as non-electrically conductive materials. One skilled in the art further understands materials and methods involved in forming wire or creating the effect of formed wire may employ materials such as cut metal foil, molded metal foil, electrically conductive inks and fluids, electrically conductive polymers and composites and the like. For example, in other embodiments, the non-electrically conductive sheath contains other types of pre-formed electrical conductors, such as electrically conductive foil or conductive tape. In one embodiment a method of manufacturing a wire formed in a pattern embedded in a non-electrically conductive structural sheath is disclosed. Examples of wire-formed patterns include wavelike, such as triangular wave, sine wave, square wave and sawtooth-wave—though one skilled in the art understands that many wave patterns are candidates to perform the necessary functions. In some embodiments the wave patterns are symmetrical, while in other embodiments the wave patterns are asymmetrical. It should be noted that multiple types of wave patterns can be combined to create specialized results.

Steps of a method include forming electrically conductive material into a pattern; surrounding the electrically conductive pattern with a polymer, such as a thermoplastic; and heating the polymer to a pliable state so as to embed the electrically conductive pattern in the polymer. In some embodiments, the polymer is heated until the polymer attains a near molten state wherein two layers are fused together, thus embedding the electrically conductive material. In other embodiments the polymer is extruded in a matter that envelopes the electrically conductive material.

In other embodiments the polymer is heat-shrink tubing. In this method, an assembly is made of a formed pattern of electrically conductive material surrounded by heat-shrink tubing; heat is applied to the assembly, thus shrinking the heat-shrink tubing around the formed pattern of electrically conductive material; the result is embedding the formed pattern of electrically conductive material in the non-electrically conductive material.

In another embodiment, non-electrically conductive polymer such as polyethylene is extruded around the formed pattern of electrically conductive material.

In still yet another embodiment, non-electrically conductive polymer such as polyethylene is molded around the formed pattern of electrically conductive material.

In yet a further embodiment, two matching lengths of non-electrically conductive film, such as tape, sandwich the formed pattern of electrically conductive material.

In still a further embodiment, a formed pattern of electrically conductive material is imprinted onto one side of a length of non-electrically conductive film or polymer strip, and a matching length of non-electrically conducting film or polymer strip is bonded on top—sandwiching and integrating the construction. The bonding is accomplished by adhesive, heat fusing, or other suitable method or technique.

One skilled in the art understands the physical and chemical properties of non-electrically conductive polymers and non-electrically conductive films, comprised of dozens of materials, any of which may be used to accomplish the intent of the disclosed invention.

BRIEF DESCRIPTION OF THE DRAWINGS

To assist those of skill in the art in making and using the disclosed versatile antenna wire, reference is made to the accompanying figures, wherein.

DETAILED DESCRIPTION

Figure 1:
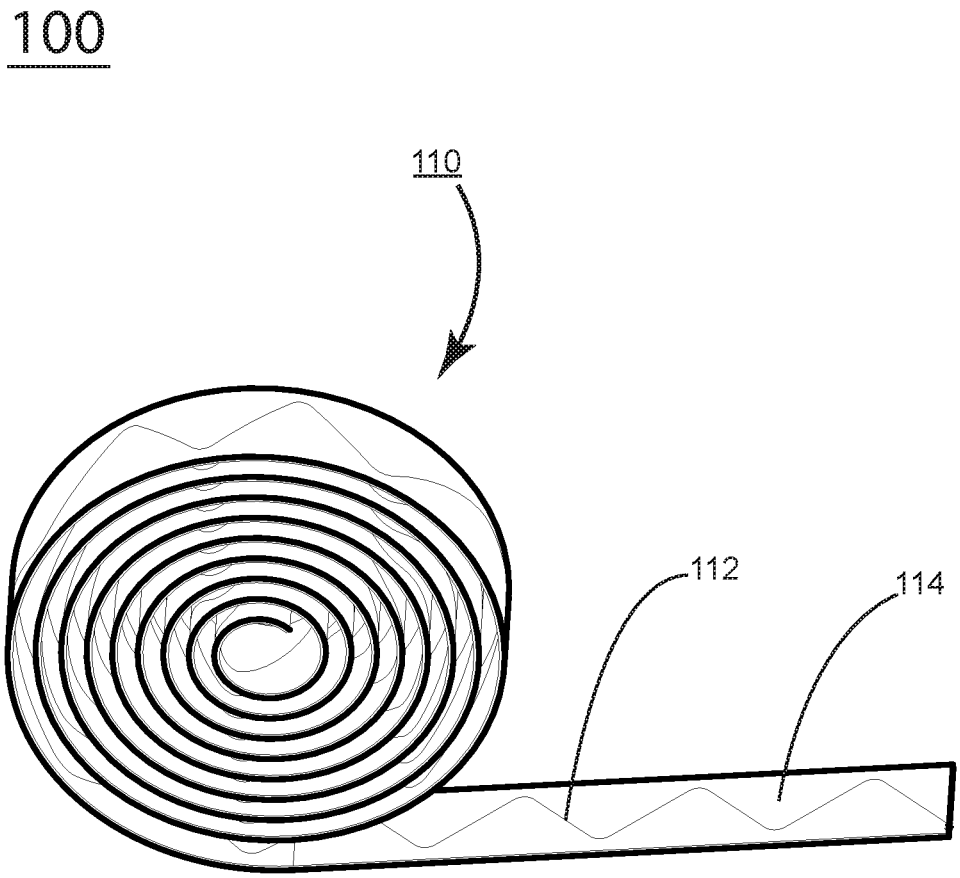
FIG. 1 is a perspective side view of a roll of versatile antenna wire constructed with a protective, non-electrically conductive sheath.

FIG. 1 is a perspective side view of a roll 100 of versatile antenna wire 110 comprised of formed pattern of electrically conductive material 112 embedded within a co-planar, protective, non-electrically conductive sheath 114. As seen, the versatile antenna wire is easy to spool up, roll out, deploy, roll up, transport, re-deploy, etc. These are important secondary benefits and advantages of the present invention, particularly in emergency-communication scenarios.

Figure 2:
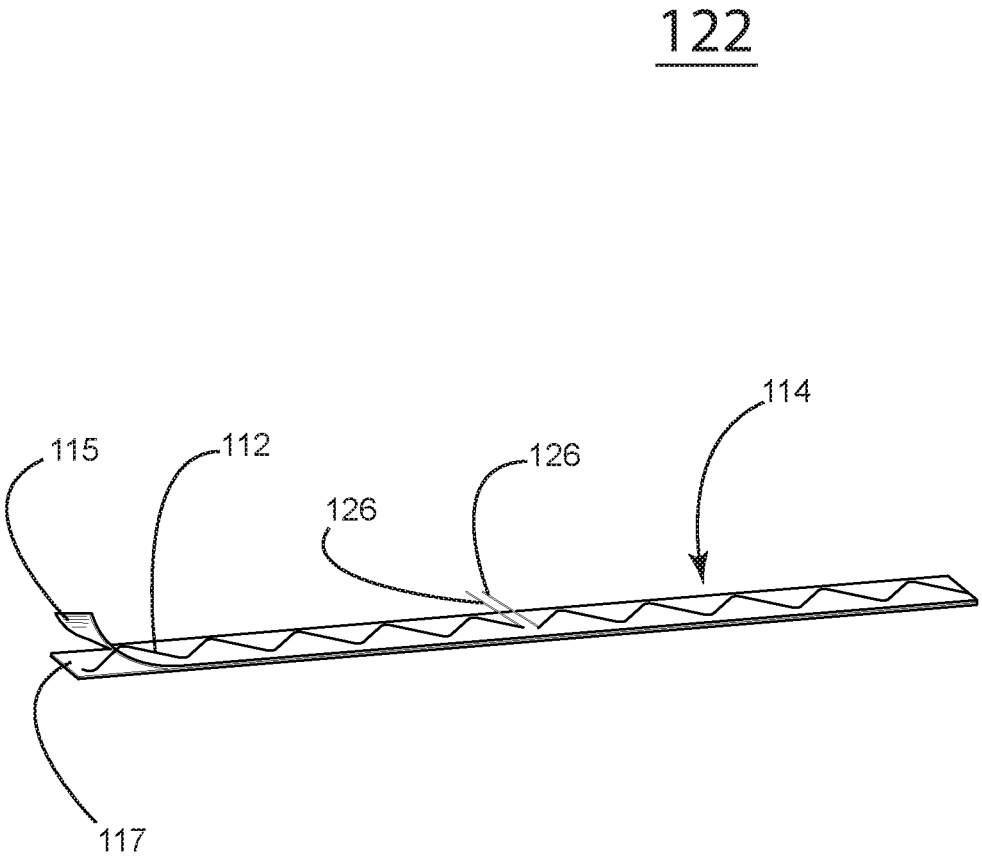
FIG. 2 is a perspective side view of a strip of versatile antenna wire constructed with a protective, non-electrically conductive sheath.

FIG. 2 is a perspective side view 122 of a strip of versatile antenna wire 114 comprised of flexible formed electrically conductive material 112, embedded within a co-planar, protective, non-electrically conductive sheath 114, showing a method of attachment to an RF feed line 126. One skilled in the art understands the function of feed line, and the choice of feed line such as coax, parallel line, and many other types of feed lines, is selected to suit a particular application. One skilled in the art also understands that the feed line is attached to the present invention in various ways and at various locations; the method and location of attachment of the feed line is chosen as appropriate for the particular application. An upper layer of non-electrically conductive material 115 and lower layer of non-electrically conductive material 117 are shown as they would be viewed prior to being integrated (bonded, fused, etc.) above and below, respectively, about a formed electrically conductive material 112.

Figure 3:
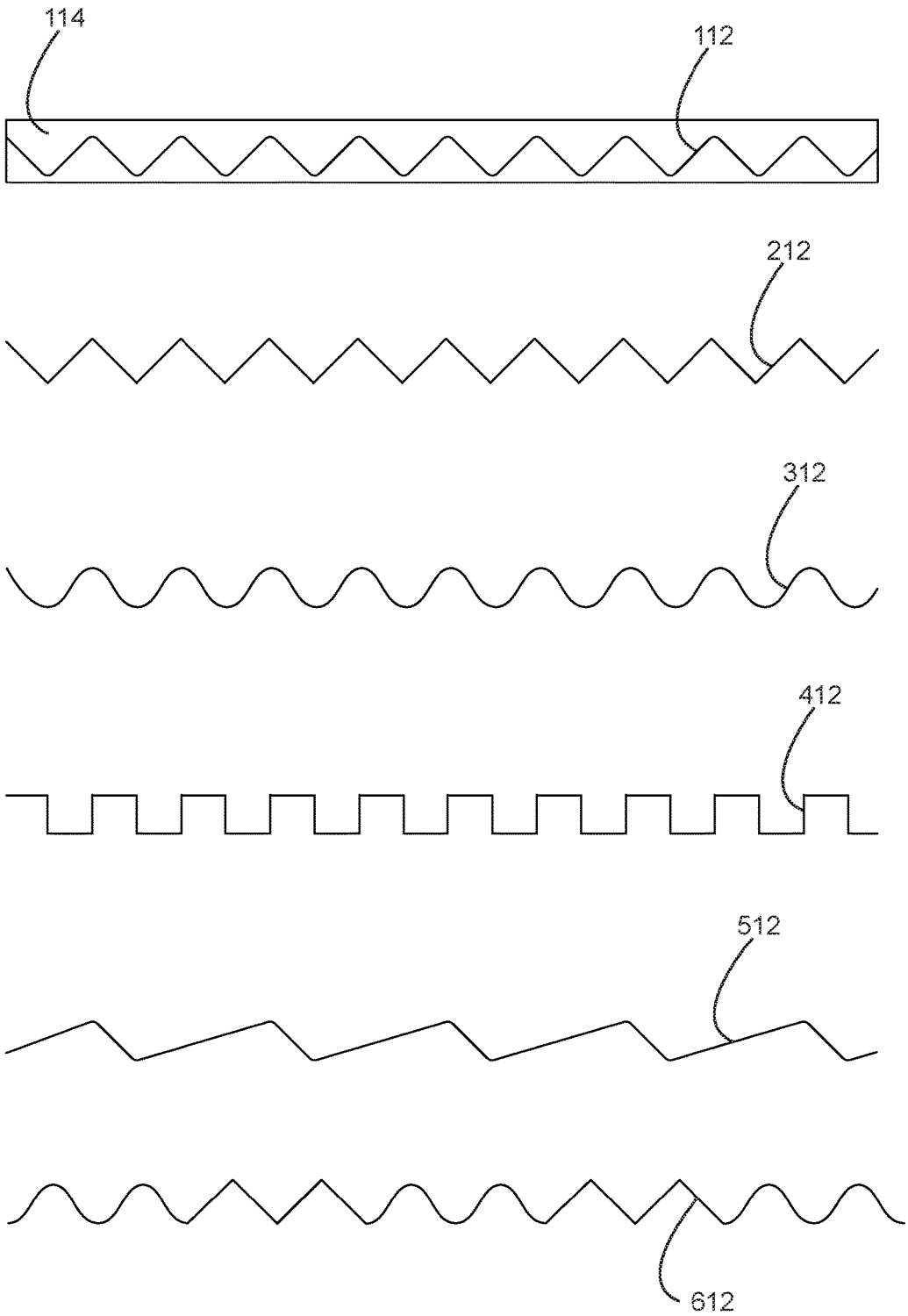
FIG. 3 is a perspective top view of various strips of versatile antenna wire configurations.

FIG. 3 is a top view of various strips of versatile antenna wire 114 comprised of electrically conductive material 112 in various configurations, including a triangle wave configuration 212, a sine wave configuration 312, a square wave configuration 412, and a sawtooth wave configuration 512, all designed to fit within a co-planar, protective, non-electrically conductive sheath 114. One skilled in the art understands that common wire may be used to form the described patterns, and further, that many electrically conductive materials may be used to create such patterns including, formed foil, die-cut foil, thin metal, printed conductive materials, electrically conductive ink, electrically conductive coating, electrically conductive polymer. and the like. One skilled in the art further understands that combinations of wave patterns are possible, for example a triangle wave and a sine wave may alternate along a path, such as depicted in 612, just as a sawtooth wave pattern may alternate along with a triangle wave pattern.

Figure 4:
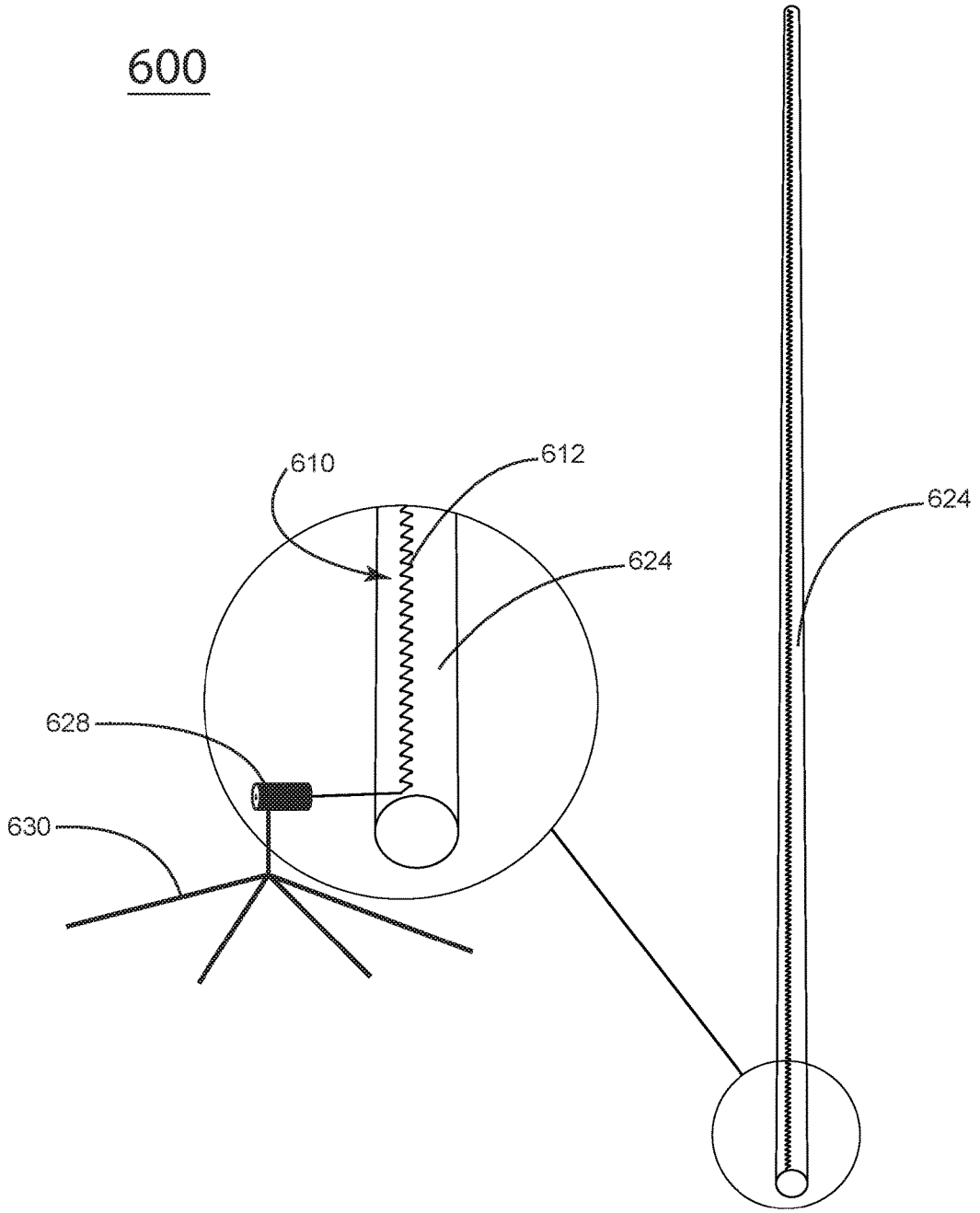
FIG. 4 is a perspective front view of versatile antenna wire constructed with a protective, non-electrically conductive structural element.

FIG. 4 is a perspective detail view 600 of a strip of versatile antenna wire 610, comprised of formed electrically conductive material 612, embedded within a co-planar, protective, non-electrically conductive structural element 624, attached to a coaxial cable feed line 628 with ground radials 630. The strip of formed electrically conductive material is mounted along a non-electrically conductive pole 624, such as a pole made of fiberglass. One skilled in the art understands that many other types of feed lines, such as parallel line, may be applied to suit a particular application. One skilled in the art also understands that various ground systems may be used, or no ground system whatsoever, depending on the particular needs of the application, as well as other interface elements (such as baluns and ununs, not depicted). It should be noted that this embodiment depicts an example of how the versatile antenna wire can produce vertical antennas that are substantially less tall than traditional vertical antennas, assisting users who have, for various reasons, antenna-height restrictions.

Figure 5:
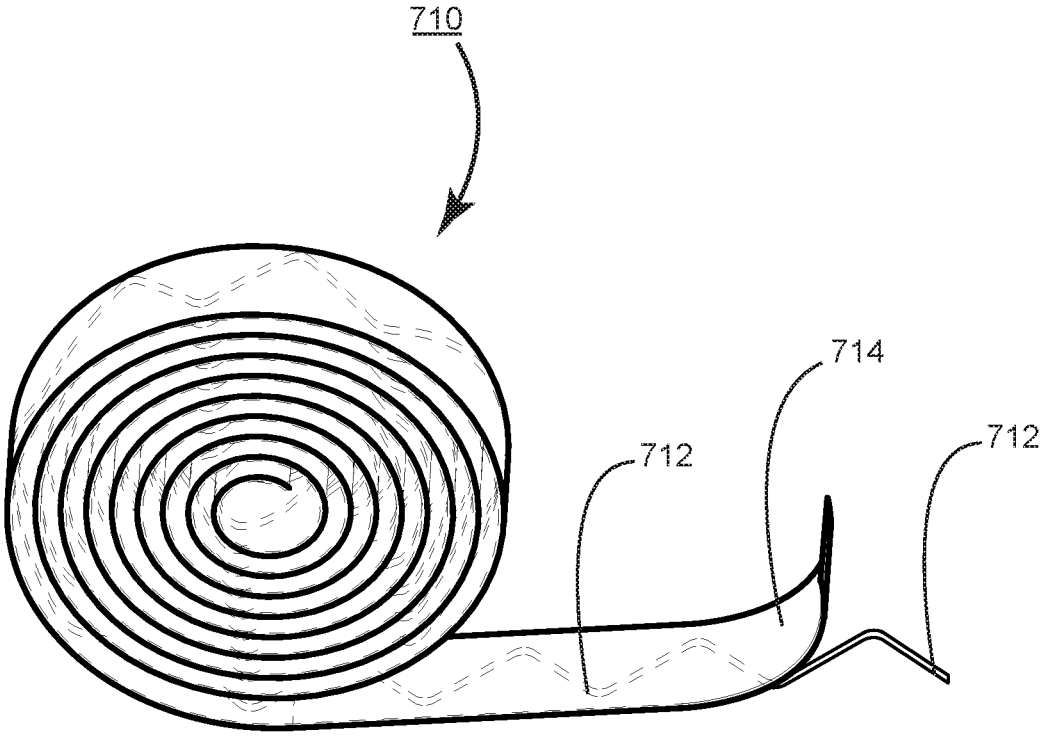
FIG. 5 is a perspective side view of a roll of versatile antenna wire as part of a non-electrically conductive substrate.

FIG. 5 illustrates an iteration of the embodiment 700 wherein a formed electrically conductive material 712 is adhered to a strip of tape 714. In this configuration, the tape and its mated electrically conductive material may be applied to a non-electrically conductive surface, structural material, or structural element.

Figure 6:
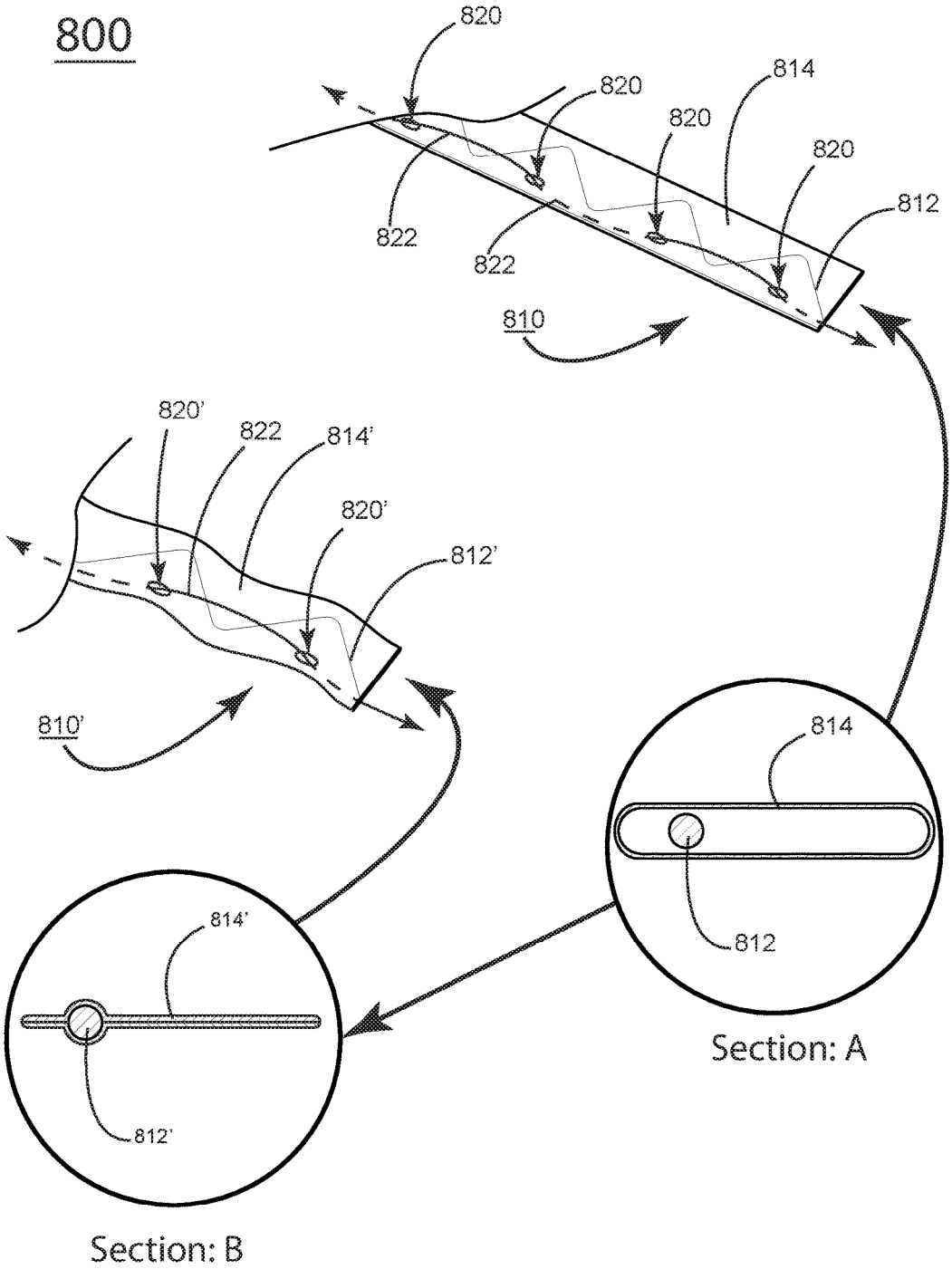
FIG. 6 is a perspective view of versatile antenna wire as constructed with heat-shrink tubing.

FIG. 6 is a detail perspective view illustrating an example of the iteration of the embodiment 800 wherein an electrically conductive material 812 is inserted into a length of heat-shrink tubing 814 to create an assembly 810 (Section: A). After applying heat, the heated shrink-tube 814' collapses and seals around the electrically conductive material 812'. Formed holes 820 pierce the heat-shrink tubing 814 and a support cord 822 is threaded through the formed holes as shown. Also depicted are formed holes 820'. Support cord 820 is unaffected by the heat process, as it is inserted in formed holes 820 after the heating of the heat-shrink tubing 814. Portions of the line that represents the support cord 822 are shown in dashed line to illustrate that a portion of the support cord 822 is on the opposite side of the heat-shrink tubing from the viewer's perspective. The final product may be created in specific, task-determined lengths or created in bulk lengths, stored, and cut to a desired length for specific applications as previously described.

One specific construction and testing of this particular embodiment was as follows: On Jun. 17, 2017, a tested construction consisted of a 32.25 feet of 16 AWG solid copper wire that was formed in repetitive, continuous equilateral triangle waveform. Each leg of the equilateral triangle was 1.5 inches in length. The internal angle, by definition of an equilateral triangle, was 60 degrees. The resulting wire waveform was inserted into a 16.5 feet length of black 30 mm I.D. cross-linked polyolefin heat-shrink tubing. The heat-shrink tubing was then heated so that it would shrink and conformally surround the internal wire waveform. 4.5 mm holes were then punched throughout the 16.5-feet length of the now-completed length of versatile antenna wire.

This construction of versatile antenna wire was then formed into an antenna by cutting the wire at its midpoint, attaching a 1:1 balun, and feeding the balun with 50 feet of RG-58 coax cable. The antenna was then suspended horizontally, 30-feet high, by a taut piece of ⅛" polyester rope, threaded through the 4.5 mm holes.

Using an MFJ-259C antenna analyzer, it was determined that the resonance frequency of this antenna system was 23.00 MHz.

Figure 7:
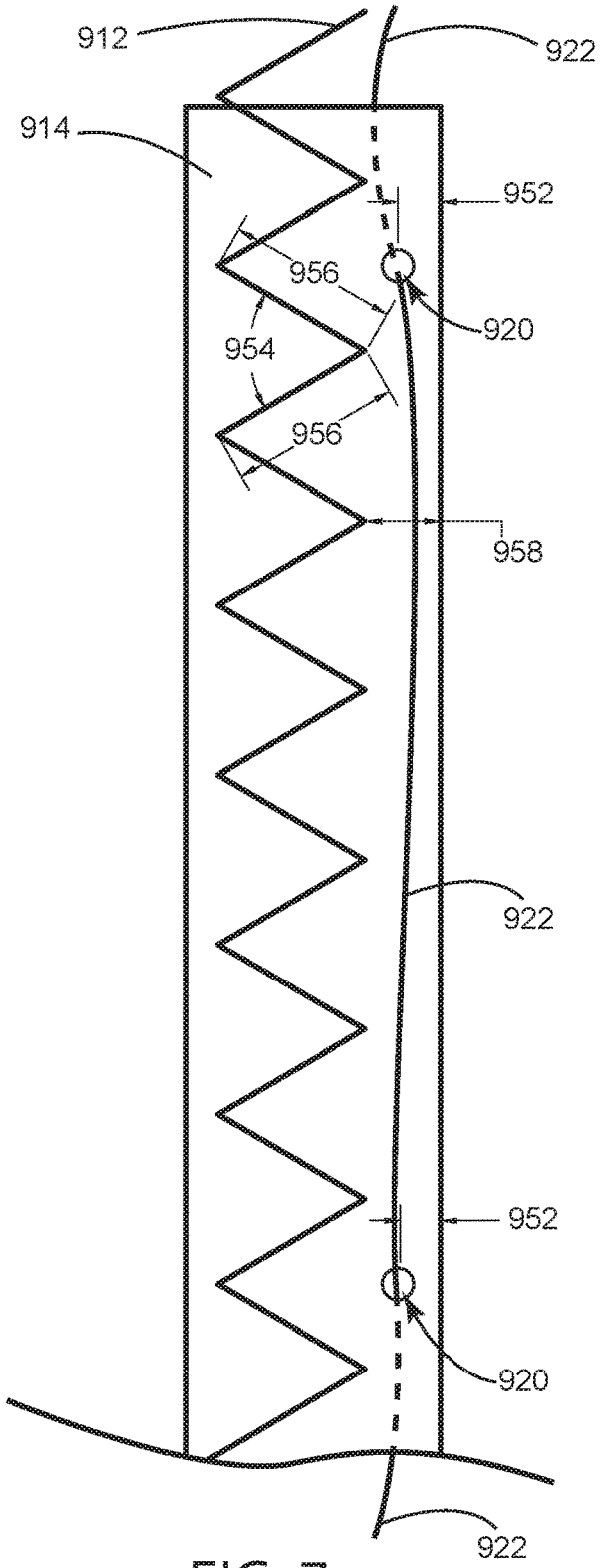
FIG. 7 is a plan view of versatile antenna wire with a non-electrically conductive support line threaded through formed holes in the protective, non-electrically conductive sheath.

FIG. 7 is a plan view of versatile antenna wire with a non-electrically conductive support line 922 threaded through formed holes 920 in the co-planer, protective, non-electrically conductive sheath 914. Electrically conductive material 912 is co-molded into non-electrically conductive injection-molded polymer 914. Alternatively, electrically conductive material 912 is sandwiched between matching strips of non-electrically conductive film to form the non-electrically conductive sheath 914.

A wave pattern has equal lengths 956 at an angle 954 with respect to each other at each bend. The angle 954 shown in this particular embodiment is 60°, but effective testing has been undertaken with angles between 10° and 160° and preferably between 25° and 90°. Holes 920 are at a distance 952 from the edge of the non-electrically conductive sheath 914. Peaks of the wave pattern reside at a distance 958 from the edge of the non-electrically conductive sheath. The distance 952 is less than the distance 958, such that a cord 922 threaded through holes 920 does not overlap the wave pattern of electrically conductive material 912.

One specific construction and testing of this particular embodiment was as follows: On Jun. 17, 2017, a tested construction consisted of a 72.32 feet of 20 AWG solid copper wire that was formed in repetitive, continuous triangle waveform. Each leg of the triangle was 1.5 inches in length. The internal angle was 30 degrees. The resulting wire waveform was sandwiched between two 15-foot strips of polypropylene packing tape.

This construction of versatile antenna wire was then formed into an antenna by cutting the wire at its midpoint, attaching a 1:1 balun, and feeding the balun with 50 feet of RG-58 coax cable. The antenna was then suspended horizontally, 30-feet high, by a taut piece of ⅛" polyester rope.

Using an MFJ-259C antenna analyzer, it was determined that the resonance frequency of this antenna system was 18.165 MHz.

Further testing of this particular embodiment occurred on Jun. 24, 2017. The tested construction of Jun. 17, 2017 was deployed as an antenna for an annual amateur "ham" radio event called Field Day. The antenna performed admirably across the 20 m, 17 m, 15 m, and 10 m amateur "ham" radio bands.

One skilled in the art recognizes that the embodiment described in FIG. 6 and FIG. 7 opens up a broad array of applications and orientations of the versatile antenna wire. For instance, the versatile antenna wire can be used in a vertical orientation, simply by threading a support cord/line (822/922) through the formed holes (820/920), and the top end of the support cord/line (822/922) affixed to an overhead structure, such as a tree limb. The result is a rapid-deploying antenna wire that could be used as an antenna system in emergency-communication scenarios, as well as in temporary-communication scenarios such as camping or hiking. The versatile antenna wire can be deployed vertically, horizontally, or sloping at angle desired. The versatile antenna wire can also be deployed in a common "inverted vee" formation, in which the midpoint of the entire wire length is higher off the ground than at the wire ends. Opportunities exist for highly efficient, shortened wire antennas of all types, including dipoles, end-feds, slopers, doublets, inverted vees, G5RVs, OCFs, long wires, and wire beams. Rigid, self-supporting electrically conductive elements, fabricated in the disclosed waveform fashions of the present invention, are also anticipated for use with traditional rigid-element beam antennas.

Over years of real-world testing, data reduction, and analysis, it has been discovered that a triangle wave pattern, with an apex angle between 23° and 33°, most typically 280, results in an end-to-end reduction in antenna-wire length of about 50% for a given operating frequency. Additional influencers to the reduction performance include the type of surrounding non-electrically conductive substrate and the properties of the formed electrically conductive material.

Figure 8:
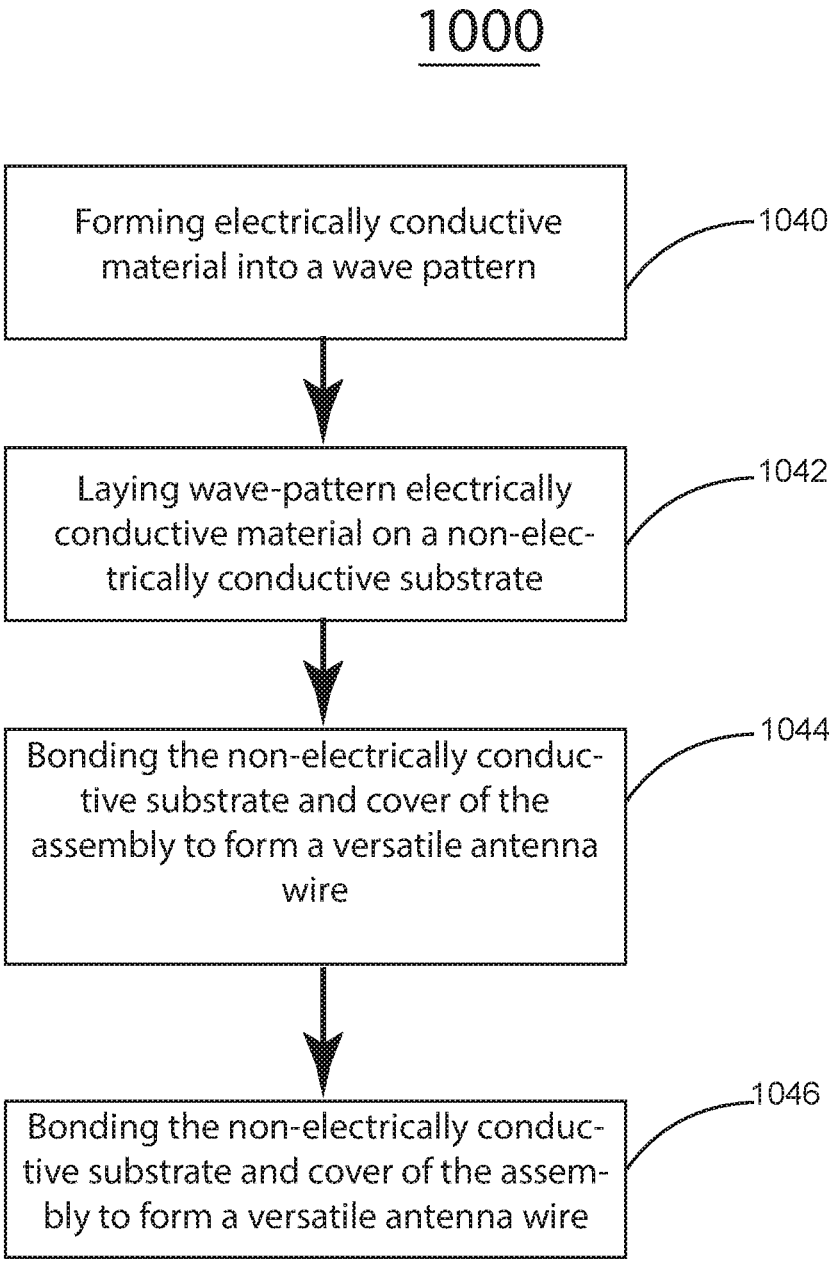
FIG. 8 is a diagram depicting a method of manufacture.

FIG. 8 is a diagram depicting a method of manufacture 1000 of a versatile antenna wire of the present disclosure. In the diagramed method the embodiment is manufactured by the steps of forming electrically conductive material into a wave pattern 1040, then laying the wave-patterned electrically conductive material on a non-electrically conductive substrate 1042. Once the wave-patterned electrically conductive material is laid on a non-electrically conductive substrate 1042, a cover of non-electrically conductive material is laid on top to form an assembly 944 after which the substrate and cover are bonded (by adhesive, temperature, or other suitable method) to form a versatile antenna wire 1046.

Figure 9:
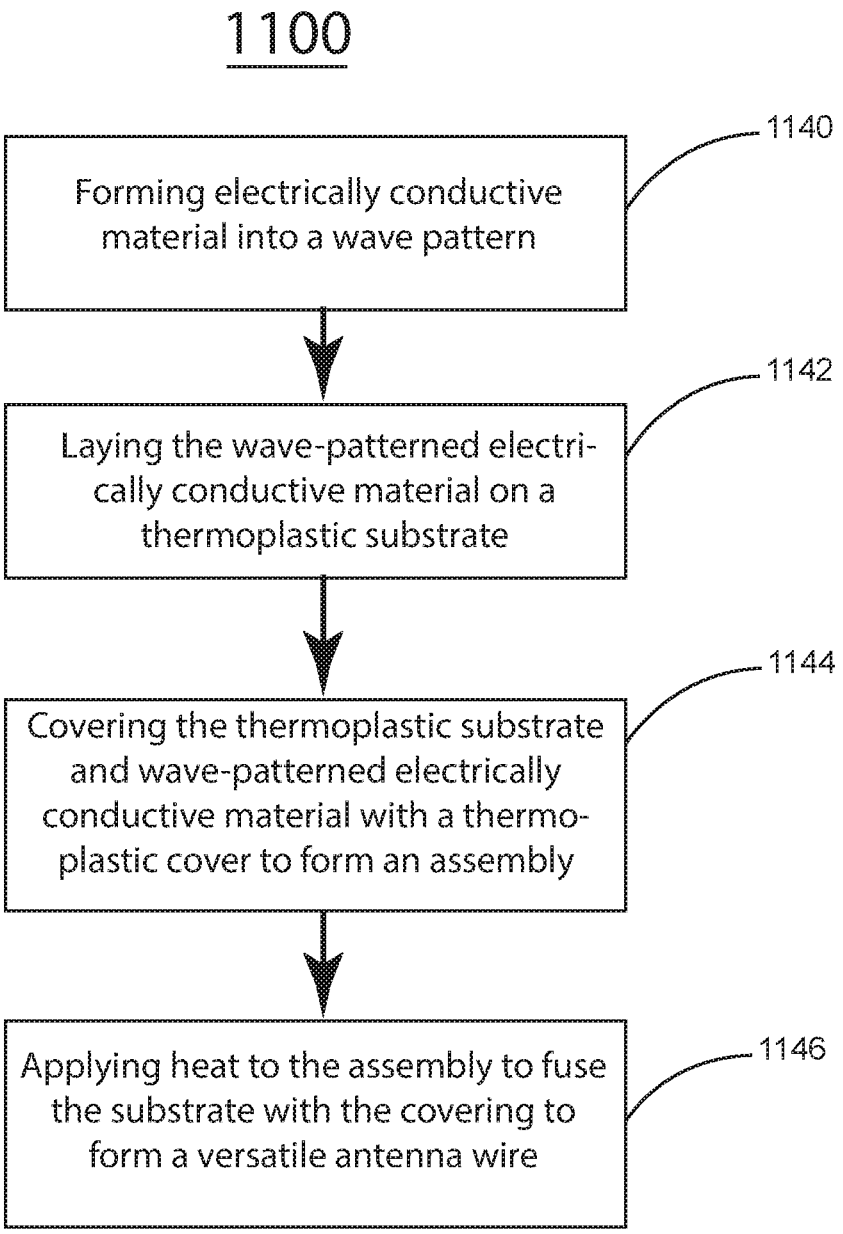
FIG. 9 is a diagram depicting a method of manufacture.

FIG. 9 is a diagram depicting a method of manufacture 1100 of a versatile antenna wire of the present disclosure. In the diagramed method the embodiment is manufactured by the steps of forming electrically conductive material into a wave pattern 1140, then laying the wave-patterned electrically conductive material on a thermoplastic substrate 1142. Once the wave-patterned electrically conductive material is laid on a thermoplastic substrate 1142, a cover of a thermoplastic substrate is laid on top to form an assembly 1144 after which applying heat to the assembly fuses the thermoplastic substrate with the thermoplastic covering to form a versatile antenna wire 1146.

Figure 10:
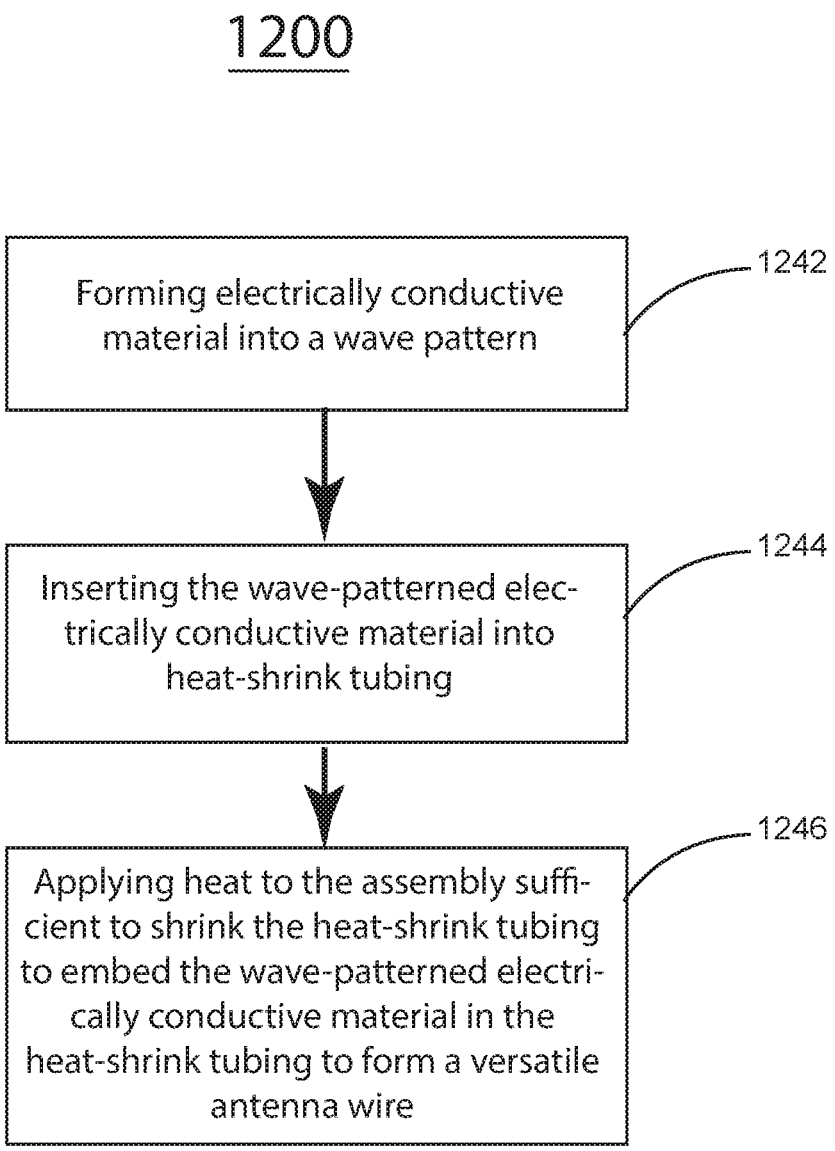
FIG. 10 is a diagram depicting a method of manufacture.

FIG. 10 is a diagram depicting a method of manufacture 1200 of a versatile antenna wire of the present disclosure. In the diagramed method the embodiment is manufactured by the steps of forming electrically conductive material into a wave pattern 1240, then inserting the wave-patterned electrically conductive material into heat-shrink tubing 1242 to form an assembly. Applying sufficient heat to the assembly, the heat-shrink tubing shrinks to embed the wave-patterned electrically conductive material in the heat-shrink tubing to form a versatile antenna wire 1246.

Figure 11:
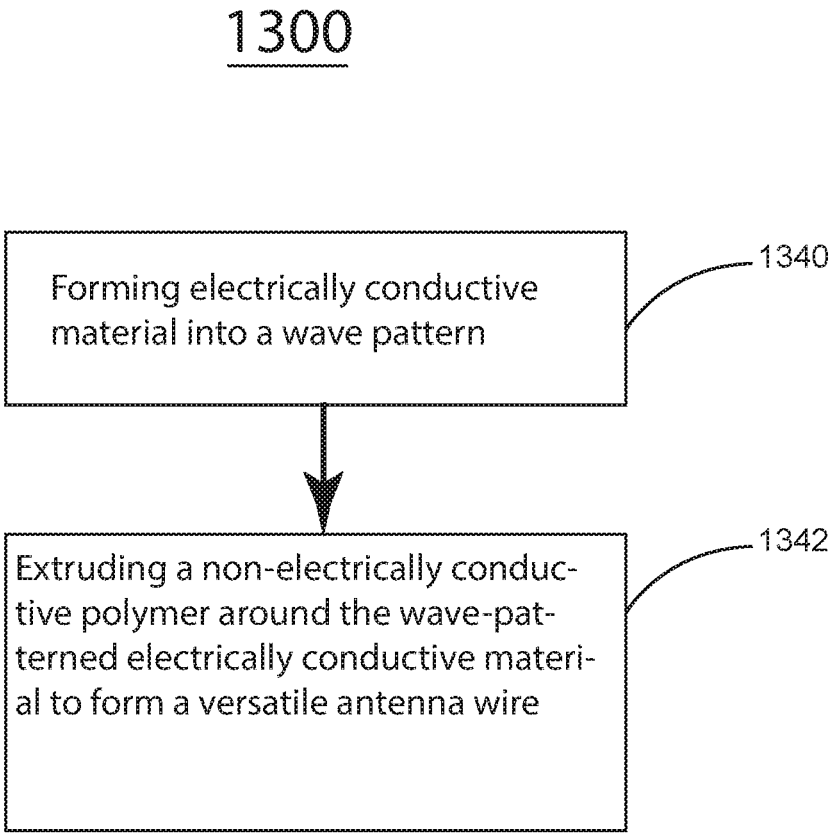
FIG. 11 is a diagram depicting a method of manufacture.

FIG. 11 is a diagram depicting a method of manufacture 1300 of a versatile antenna wire of the present disclosure. In the diagramed method the embodiment is manufactured by the steps of forming electrically conductive material into a wave pattern 1340, then extruding a non-electrically conductive polymer, such as polyethylene, around the formed pattern to form a versatile antenna wire 1342.

Figure 12:
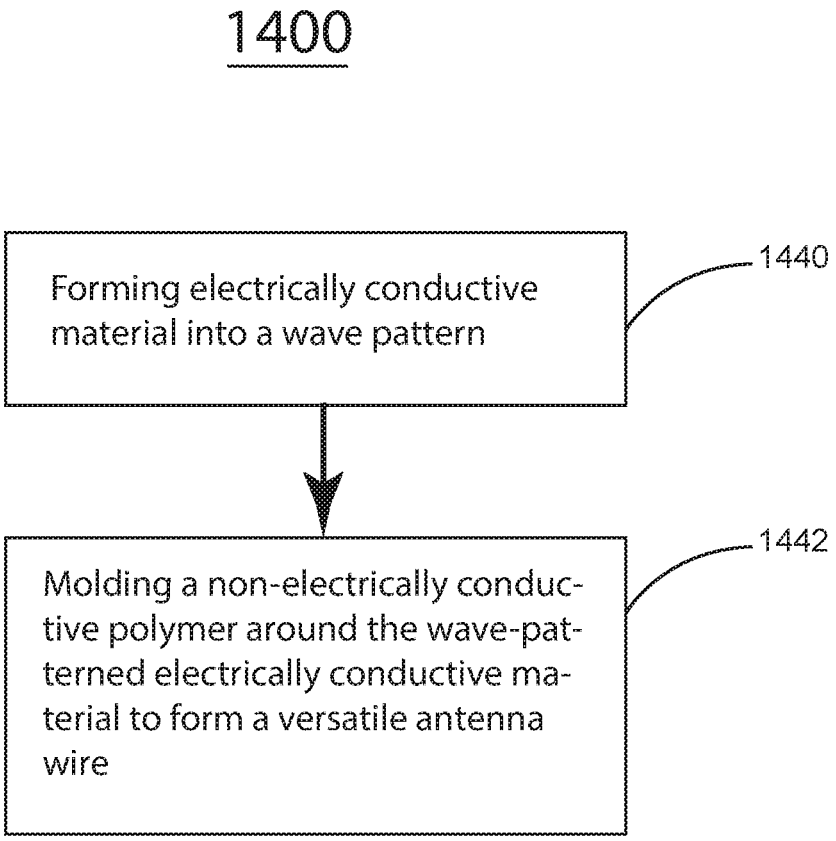
FIG. 12 is a diagram depicting a method of manufacture.

FIG. 12 is a diagram depicting a method of manufacture 1400 of a versatile antenna wire of the present disclosure. In the diagramed method the embodiment is manufactured by the steps of forming electrically conductive material into a wave pattern 1440, then molding a non-electrically conductive polymer, such as polyethylene, around the formed pattern to form a versatile antenna wire 1442.

One skilled in the art understands that variations of the aforementioned embodiments may be combined in novel ways not specifically illustrated here.

Additionally, one skilled in the art understands that some of the aforementioned embodiments may be configured such that connected feed lines are positioned at various points along the formed wire or at the ends of the formed wire.

The invention claimed is:

1. Antenna wire comprising:

a wire formed in a planar waveform pattern, wherein the waveform pattern is a triangle wave, said wire formed in a planar waveform pattern embedded in a non-electrically conductive material, wherein said wire formed in a planar wave form pattern is embedded in a non-electrically conductive material cut to specific lengths for sending and receiving radio signals, and wherein the apex angle of said triangle wave is between approximately 20° and approximately 33°, resulting in an end-to-end reduction in antenna-wire length of approximately 50% for a given operating frequency.

2. The antenna wire of claim 1 wherein the non-electrically conductive material is a non-electrically conductive polymer.

3. The non-electrically conductive polymer of claim 2 wherein non-electrically conductive polymer is selected from the group consisting of polyethylene, polypropylene, thermoplastic polyurethane, nylon, PVC, neoprene, rubber, or silicone.

4. The non-electrically conductive polymer of claim 2 is non-electrically conductive film that sandwiches the wire formed in a planar waveform pattern.

5. The non-electrically conductive film of claim 4 wherein non-electrically conductive film is comprised of a material selected from the group consisting of acrylic, fluoropolymer, PET, polyester, polymer, polyimide, PVC, vinyl, rubber, and silicone.

6. The antenna wire of claim 1 wherein the non-electrically conductive material is heat-shrink tubing.

7. Antenna wire comprising:

an electrically conductive material formed in a planar, alternating-direction pattern, wherein alternating-direction pattern is a triangle wave, and a non-electrically conductive material surrounding said electrically conductive material, wherein the apex angle of said triangle wave is between approximately 20° and approximately 33°, resulting in approximately 50% reduction in end-to-end antenna-wire length for a given operating frequency.

8. The antenna wire of claim 7 wherein the electrically conductive material is selected from the group consisting of wire, metal foil, metal substrate, electrically conductive ink, electrically conductive coating, electrically conductive polymer, and electrically conductive composite.

9. The antenna wire of claim 7 wherein the non-electrically conductive material is a non-electrically conductive polymer.

10. The non-electrically conductive polymer of claim 9 is selected from the group consisting of polyethylene, polypropylene, thermoplastic polyurethane, nylon, PVC, neoprene, rubber, and silicone.

11. The antenna wire of claim 7 wherein the non-electrically conductive material is heat-shrink tubing.

12. The non-electrically conductive polymer of claim 7 comprising opposing bonded strips of non-conductive polymer that sandwich the electrically conductive material.

13. The bonded strips of claim 12 comprising strips of non-electrically conductive film.

14. The non-electrically conductive film of claim 13 is comprised of a material selected from the group consisting of acrylic, fluoropolymer, PET, polyester, polymer, polyimide, PVC, vinyl, rubber, and silicone.

15. A method of manufacturing antenna wire, the steps comprising:

forming electrically conductive material into a planar wave pattern, wherein the planar wave pattern is a triangle wave, and encapsulating said electrically conductive material with non-electrically conductive material, wherein the apex angle of said triangle wave is between approximately 20° and approximately 33°, resulting in approximately 50% reduction in end-to-end antenna-wire length for a given operating frequency.

16. A method of manufacturing antenna wire, the steps comprising:

forming electrically conductive material into a planar wave pattern, wherein the planar wave pattern is a triangle wave, sandwiching said electrically conductive material with opposing strips of nonelectrically conductive polymer, and bonding together said opposing strips of non-electrically conductive polymer, wherein the apex angle of said triangle wave is between approximately 20° and approximately 33°, resulting in approximately 50% reduction in end-to-end antenna-wire length for a given operating frequency.

17. A method of manufacturing antenna wire, the steps comprising:

forming electrically conductive material into a planar wave pattern, wherein the planar wave pattern is a triangle wave, and extruding a non-electrically conductive polymer to encase the electrically conductive material, wherein the apex angle of said triangle wave is between approximately 20° and approximately 33°, resulting in approximately 50% reduction in end-to-end antenna-wire length for a given operating frequency.

18. A method of manufacturing antenna wire, the steps comprising:

forming electrically conductive material into a planar wave pattern, wherein the planar wave pattern is a triangle wave, and casting a non-electrically conductive polymer to encase the electrically conductive material, wherein the apex angle of said triangle wave is between approximately 20° and approximately 33°, resulting in approximately 50% reduction in end-to-end antenna-wire length for a given operating frequency.

19. A method of manufacturing antenna wire, the steps comprising:

forming electrically conductive material into a planar wave pattern, wherein the planar wave pattern is a triangle wave, inserting said electrically conductive material into a heat-shrink tube, and heating said heat-shrink tube to encase the electrically conductive material, wherein the apex angle of said triangle wave is between approximately 20° and approximately 33°, resulting in approximately 50% reduction in end-to-end antenna-wire length for a given operating frequency.

* * * * *